US006898948B2

(12) United States Patent
Roelke et al.

(10) Patent No.: US 6,898,948 B2
(45) Date of Patent: May 31, 2005

(54) SCREW COMPRESSOR

(75) Inventors: Stephan Roelke, Filderstadt (DE); Klaus Hossner, Magstadt (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 10/655,105

(22) Filed: Sep. 3, 2003

(65) Prior Publication Data

US 2004/0040332 A1 Mar. 4, 2004

(30) Foreign Application Priority Data

Sep. 3, 2002 (DE) ..... 102 42 139

(51) Int. Cl.[7] ..... F25B 31/00
(52) U.S. Cl. ..... 62/505; 62/508
(58) Field of Search ..... 62/505, 508; 418/201, 418/201.2

(56) References Cited

U.S. PATENT DOCUMENTS

| | | | | |
|---|---|---|---|---|
| 3,568,466 A | | 3/1971 | Brandin et al. | |
| 3,756,753 A | * | 9/1973 | Persson et al. | 418/9 |
| 4,220,197 A | * | 9/1980 | Schaefer et al. | 165/263 |
| 4,478,054 A | | 10/1984 | Shaw et al. | |
| 4,545,742 A | | 10/1985 | Schaefer | |
| 6,276,911 B1 | | 8/2001 | Krusche et al. | |
| 6,341,496 B1 | | 1/2002 | Kettner et al. | |

FOREIGN PATENT DOCUMENTS

| | | |
|---|---|---|
| DE | 685 768 | 12/1939 |
| DE | 2 134 181 | 11/1973 |
| DE | 197 57 829 | 7/1999 |
| EP | 1 057 669 | 12/2000 |
| EP | 1 072 796 | 1/2001 |
| GB | 1 454 979 | 11/1976 |

OTHER PUBLICATIONS

Herbrich, M., "Druckluft Ohne Puls Drehkolbengeblase Mit Integriertem Pulsationsabbau", Chemie Technik, Bd. 23, No. 4, Apr. 1, 1994,pp. 92–94.

* cited by examiner

*Primary Examiner*—Melvin Jones
(74) *Attorney, Agent, or Firm*—Barry R. Lipsitz; Douglas M. McAllister

(57) ABSTRACT

In order to provide a screw compressor comprising two screw rotors which are disposed in screw rotor bores in a compressor casing and which compress a refrigerant entering at a refrigerant inlet and discharge it at a refrigerant outlet, and comprising an inlet provided in the compressor casing for refrigerant which is coming from a subcooling circuit and is passed to the inlet in a system of lines, the inlet being disposed in such a way that it opens out into compression spaces enclosed by the screw rotors and screw rotor bores, in which compressor the pressure oscillations or pulsations occurring at the inlet propagate as little as possible to the pipeline system of the subcooling circuit outside the compressor casing, it is proposed that the inlet is preceded by a damper channel which is associated with the system of lines and in which refrigerant from the subcooling circuit is present.

25 Claims, 5 Drawing Sheets

SCREW COMPRESSOR

The present disclosure relates to the subject matter disclosed in German application No. 102 42 139.0 of Sep. 3, 2002, which is incorporated herein by reference in its entirety and for all purposes.

BACKGROUND OF THE INVENTION

The invention relates to a screw compressor, comprising two screw rotors which are disposed in screw rotor bores in a compressor casing and which compress a refrigerant entering at a refrigerant inlet and discharge it at a refrigerant outlet, and comprising an inlet disposed in the compressor casing for refrigerant which is coming from a supercooling circuit and is passed to the inlet via a system of lines, the inlet being disposed in such a way that it opens out into compression spaces enclosed by the screw rotors and screw rotor bores.

In the case of screw compressors of this type there is the problem that the compression spaces enclosed by the screw rotors and screw rotor bores moving past the inlet cause pressure oscillations or pulsations, which propagate into the pipeline system of the supercooling circuit and lead to noise and possibly also to problems in terms of stability and sealing.

It is therefore an object of the invention to provide a screw compressor in which the pressure oscillations or pulsations occurring at the inlet propagate as little as possible to the pipeline system of the supercooling circuit outside the compressor casing.

SUMMARY OF THE INVENTION

This object is achieved in the case of a screw compressor of the type described at the beginning according to the invention by the inlet being preceded by a damper channel which is associated with the system of lines and in which refrigerant from the supercooling circuit is present.

The provision of such a damper channel provides the possibility of reducing the pressure oscillations or pulsations occurring at the inlet.

In principle, it would be conceivable to provide the damper channel in the pipeline system of the supercooling circuit.

However, in order to prevent from the outset the pressure oscillations or pulsations from spreading with an appreciable intensity into the pipeline system and leading to oscillations in the latter, it is preferably provided that the damper channel is disposed in the compressor casing.

With regard to the way in which the damper channel is disposed in the compressor casing, a wide variety of possibilities are conceivable.

For example, it would be conceivable to produce the compressor casing from a number of casing portions and to provide the damper channel in one casing portion, while the screw rotor bores are disposed in another casing portion.

It is particularly advantageous, however, if the damper channel is formed in a casing portion which receives the screw rotor bores and consequently forms an integral unit which additionally reduces propagation of the pressure oscillations.

In principle, the damper channel may in this case be formed as a side arm of the system of lines and therefore not be constantly flowed through.

In order to obtain a compact construction of the damper channel, in an advantageous exemplary embodiment an inlet channel running through the compressor casing is provided as part of the system of lines which leads from an outer connection on the compressor casing, connected to the pipeline system of the supercooling circuit, to the inlet, the damper channel being disposed in the inlet channel.

It is likewise possible for the damper channel to be provided in the compressor casing in a wide variety of ways.

For example, it would be conceivable to form the damper channel in a unitary manner with the compressor casing receiving it.

However, a particularly advantageous exemplary embodiment provides that the damper channel is disposed in a part which can be inserted into the compressor casing.

In this case, this part could comprise both the inlet channel and the damper channel. However, it Is particularly advantageous if the part which can be inserted into the compressor casing can be inserted into the inlet channel in the compressor casing.

An exemplary embodiment which is suitable with regard to the design provides that the insertable part comprises a damper tube and a holder, by which the damper tube can be fixed in the compressor casing.

This solution is advantageous in design terms to the extent that the damper tube and the holder can be inserted into the inlet channel at a subsequent time.

Particularly suitable fixing of the damper tube and the holder in the inlet channel in this case provides positive fixing of the holder in the inlet channel.

With regard to the further formation of the screw compressor, no more details have been given in connection with the explanation so far of the individual exemplary embodiments. For instance, a particularly advantageous exemplary embodiment provides that the compressor casing comprises a control slide, and that the inlet is disposed in the control slide and can be displaced with it.

In the case of this solution of the screw compressor according to the invention, the latter can be controlled with regard to the obtainable compression and, at the same time as the controllability, it is also possible independently of the control to operate the supercooling circuit effectively.

With regard to the formation of the connection between the inlet and the inlet channel, a wide variety of solutions are conceivable. For example, it is conceivable to provide in the control slide and in the compressor casing portions which overlap one another in all positions of the control slide and by means of which the inlet channel can be led into the control slide. A solution which is advantageous in design terms provides that the inlet in the control slide is connected to the outer connection via a portion of the inlet channel of variable length.

It is particularly advantageous in this case if the portion of the inlet channel of variable length is telescopically formed.

A suitable embodiment of such a portion of the Inlet channel of variable length provides that the portion of the inlet channel of variable length is formed by a connecting pipe which can be pushed into a receiving channel.

With regard to the length of the damper channel, no further detail have been given in connection with the explanation so far of the solution according to the invention. For instance, a particularly advantageous solution provides that the damper channel is of a length which corresponds approximately to a quarter of the wavelength of the pressure oscillations to be damped or an odd multiple of the same.

The wavelength of the pressure oscillations to be damped can in this case be determined from a fundamental frequency of the pressure oscillations, the fundamental frequency of the pressure oscillations resulting from the product of the rotational speed of the screw rotors and the number of screw flights.

The damper channel acts particularly efficiently if it opens out with a first mouth opening into a first volume lying between the outer connection and the first mouth opening, so that the first mouth opening represents a so-called "open end" of the damper channel, at which a reflection of the pressure oscillations takes place at the so-called "open end".

Furthermore, it is advantageously provided that the damper channel opens out with a second mouth opening into a second volume lying between said second opening and the inlet, so that there is also a so-called open end at the second mouth opening.

To obtain the most advantageous possible conditions for a reflection at the so-called "open end", it is preferably provided that there is a sudden change in the cross-sectional surface area at the transition from one of the mouth openings into the respective volume. The sudden change in the cross-sectional surface area should be as great as possible. It is preferably provided that the sudden change in the cross-sectional surface area is at least a factor of 1.5.

To reduce or largely avoid propagation of the pressure oscillations or pulsations into the pipeline system of the supercooling circuit, it is preferably provided that the first volume, lying between the first mouth opening and the outer connection, lies in the compressor casing.

In this case, the first volume preferably lies in an inlet channel portion of the inlet channel led through the compressor casing.

Furthermore, it is likewise of advantage with regard to optimum damping of the pressure oscillations or pulsations if the second volume, lying between the second mouth opening and the inlet, likewise lies in the compressor casing.

The second volume advantageously likewise extends in the inlet channel portion receiving the damper channel.

In the case of a further advantageous exemplary embodiment, the connection for the supercooling circuit has an associated expansion volume.

This expansion volume can likewise also be provided in the inlet channel and in the compressor casing.

For reasons of space, however, it has proven to be advantageous if the expansion volume is provided near the outer connection for the supercooling circuit in the pipeline system of the supercooling circuit.

No further details have been given in connection with the explanation so far of the solution according to the invention concerning the fact that oil can accumulate in the damper channel, reducing the effect of the damper channel.

Such an accumulation of oil in the damper channel may take place when the supercooling circuit is not effective, but under certain circumstances even when the supercooling circuit is effective.

For this reason, a particularly advantageous solution provides that the system of lines is connected to an oil drain, which provides that oil, in particular oil accumulating near the damper channel, is drained from the system of lines.

It is particularly advantageous in this case if the oil drain opens out into the inlet channel, in particular if the damper channel is provided in the latter, since this provides the possibility of avoiding as far as possible accumulations of oil near the location of the damper channel.

A particularly advantageous solution provides that the oil drain opens out into the first volume. With the oil drain disposed in this way, there is the possibility of avoiding accumulations of oil in particular in the region of the first volume, and consequently of maintaining the effect of the damper channel.

In particular, it is of advantage in this case that the effect of the damper channel is ensured by no accumulations of oil forming at its mouth opening facing the outer inlet.

Further features and advantages of the invention are the subject of the description which follows and the graphic representation of some exemplary embodiments.

DETAILED DESCRIPTION OF THE INVENTION

Figure 1:
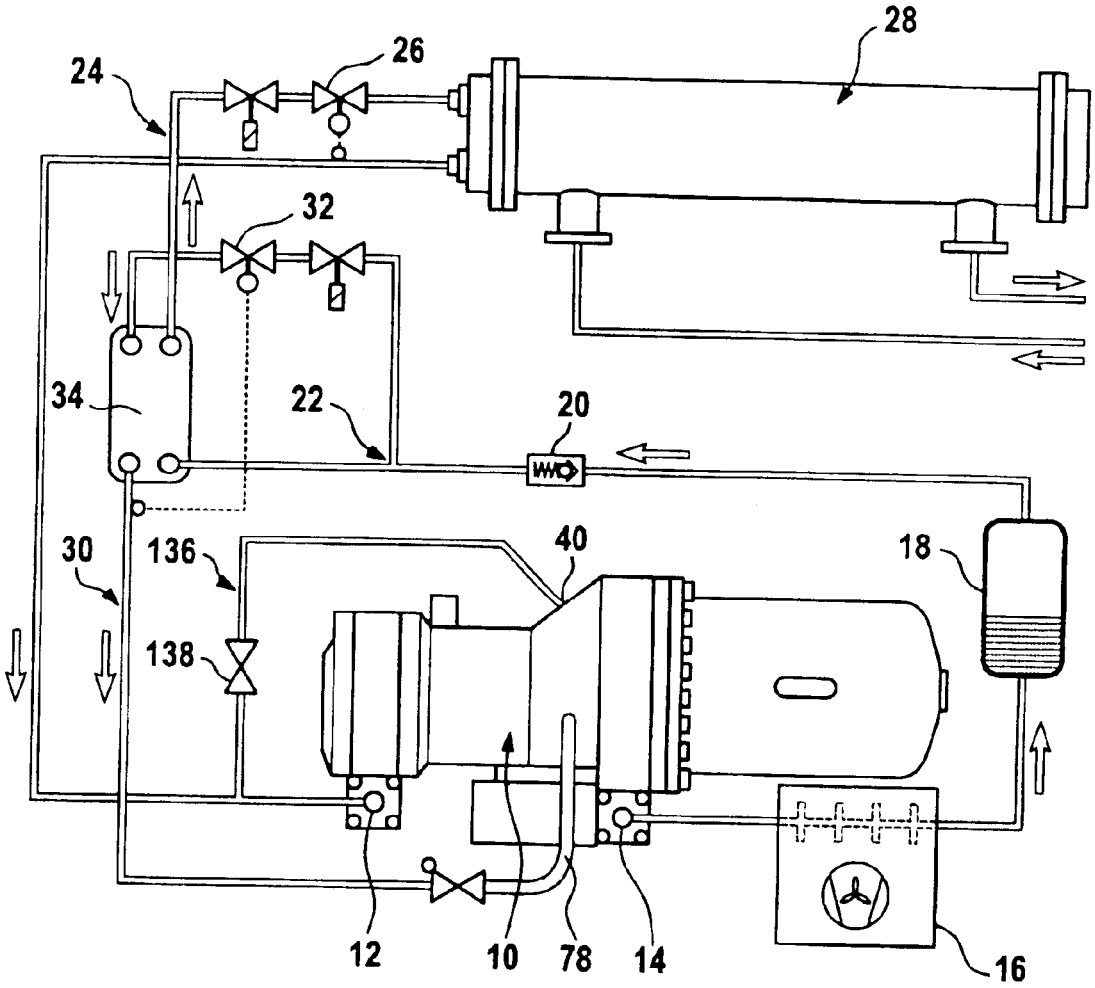
FIG. 1 shows a setup of a screw compressor according to the invention in a cooling circuit with a supercooling circuit.

A first exemplary embodiment of a screw compressor according to the invention, represented in FIG. 1, comprises a compressor casing, which is designated as a whole by 10 and on which a suction connection 12 and a pressure connection 14 are provided, refrigerant being sucked in at the suction connection 12 and compressed refrigerant being delivered at the pressure connection 14.

The compressed refrigerant delivered at the pressure connection 14 is first fed to a condenser 16 and passes from the condenser 16 into an intermediate store 18 for liquid refrigerant. After the intermediate store 18, the condensed refrigerant flows through a non-return valve 20 and a branch 22, from which a cooling circuit 24 leads further to an expansion valve 26 and an evaporator 28, and then back again from the evaporator 28 to the suction connection 12.

Provided in addition to the cooling circuit 24 is a supercooling circuit 30, which branches off from the cooling circuit 24 at the branch 22 and has an expansion valve 32, through which part of the mass flow of the refrigerant from the cooling circuit 24, which has first been compressed by the screw compressor, expands and is fed to a supercooler 34, flows through the supercooler 34 and is then directed to a connection 40 provided on the compressor casing 10 for the supercooling circuit 30.

At the same time, the refrigerant circulated in the cooling circuit 24 between the branch 22 and the expansion valve 26 likewise flows through the supercooler 34 and undergoes further supercooling in the supercooler 34 before its expansion in the expansion valve 26, which leads to the effect that, with the additional supercooling circuit 30 in the cooling circuit 24, the refrigerating capacity and the performance coefficient are improved, even though the power requirement of the screw compressor is increased only slightly.

Figure 2:
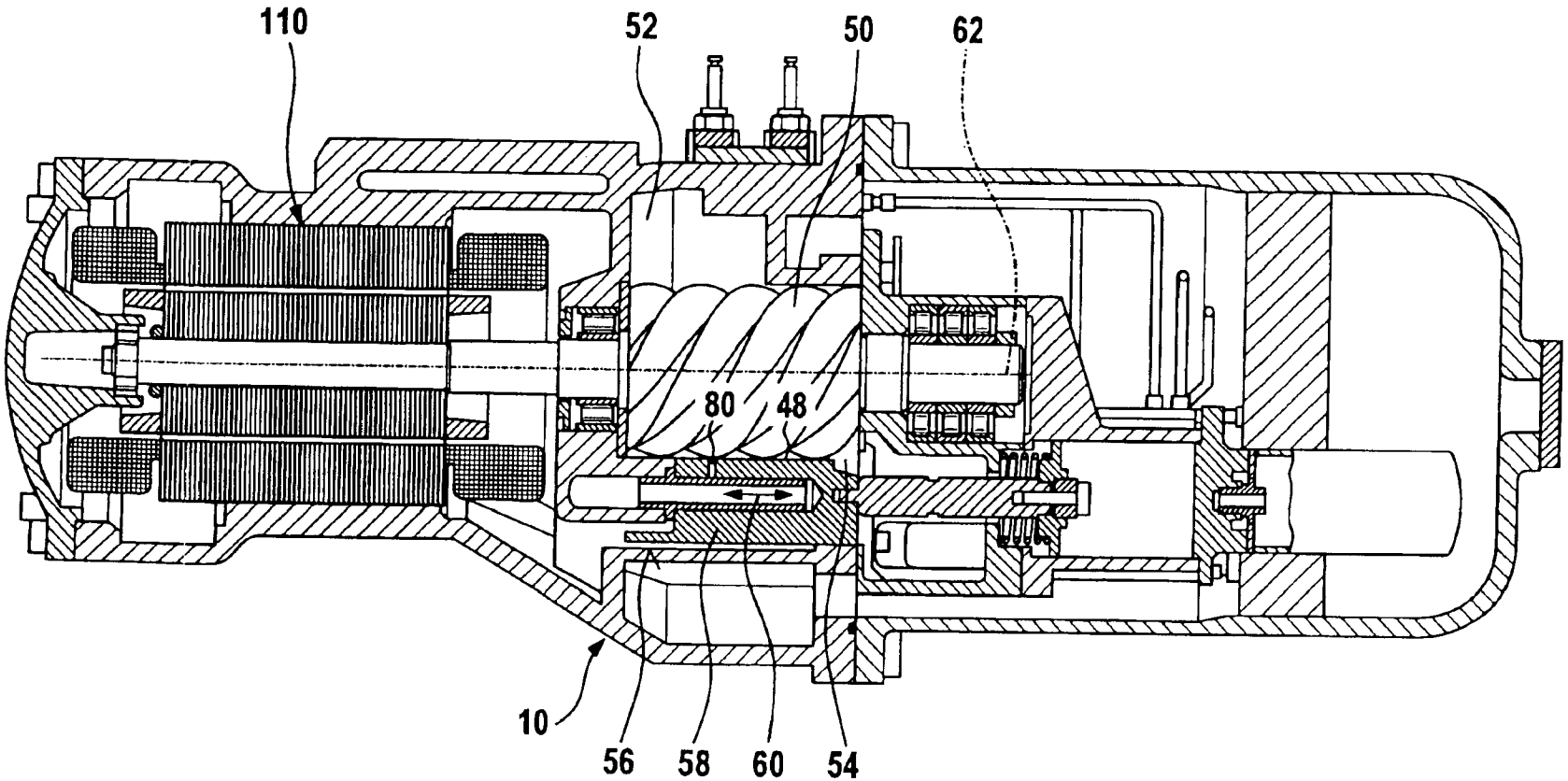
FIG. 2 shows a longitudinal section through a first exemplary embodiment of a screw compressor according to the invention.
Figure 3:
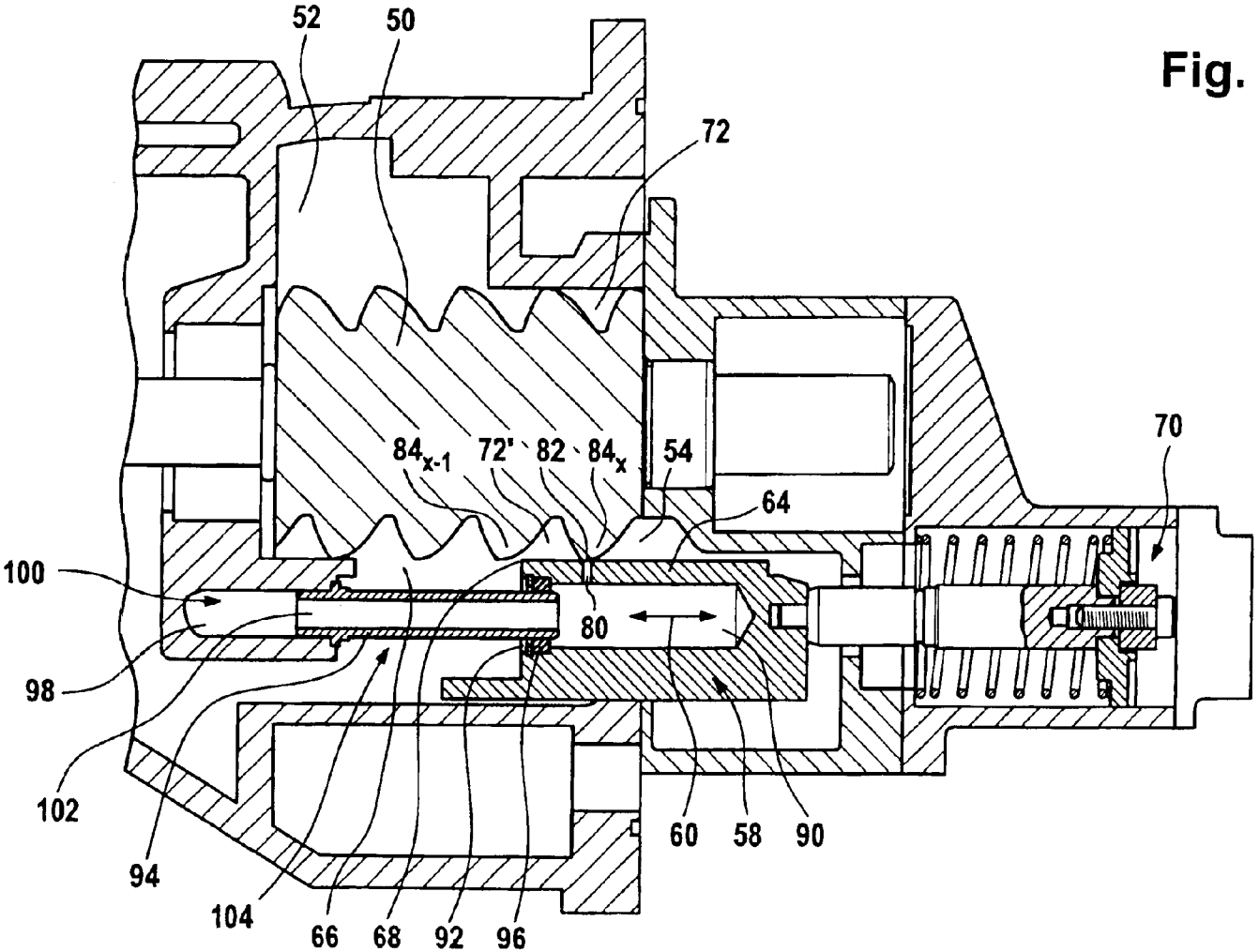
FIG. 3 shows an enlarged representation of the longitudinal section according to FIG. 2 in the region of a control slide.

As represented in detail in FIGS. 2 and 3, a first exemplary embodiment of a screw compressor according to the Invention comprises screw rotor bores 48 which are provided in the compressor casing 10 and in which interengaging screw rotors 50 are rotatably disposed, the screw rotor bores 48 extending from a refrigerant inlet 52 on the suction side to a refrigerant outlet 54 on the pressure side and the interengaging screw rotors 50 sucking in the refrigerant in the region of the refrigerant inlet 52, compressing it on its way to the refrigerant outlet 54 and delivering it as compressed refrigerant at the refrigerant outlet 54. Also provided in the compressor casing 10 is a recess 56, in which a control slide 58 is movable in a direction 60 which runs parallel to an axis of rotation 62 of the screw rotor 50.

With a valve wall 64 facing the screw rotors 50, the control slide 58 forms one wall side of the screw rotor bores 48, which by being displaceable in the direction 60 creates the possibility of controlling the compression that can be achieved by the screw rotors 50. In the case of the position represented in FIG. 2, the entire valve wall 64 extends along the screw rotors 50, and creates the possibility of the screw rotors 50 contributing over their entire length in the direction of their axis of rotation 62 to the compression of the refrigerant, whereas, in the case of the position of the control slide 58 represented in FIG. 3, said control slide has been displaced to the extent that only a subregion of the valve wall 64 is adjacent to the screw rotors 50 and consequently the screw rotors 50 contribute only over part of their length to the compression of the refrigerant, that is with the part which is adjacent to the valve wall 64, whereas displacement of the control slide 58 after the refrigerant inlet 52 has the effect of forming a clearance 66 between the latter and an edge 68 on the suction side of the control slide 58, which makes the region of the screw rotors 50 adjacent to the clearance 66 ineffective with regard to the compression of the refrigerant.

The control slide 58 is in this case able to be actuated by means of an adjusting device 70, which may be formed for example in the way described in European patent application 1 072 796.

The adjusting device 70 may, however, also be formed differently and, for example, be able to be continuously actuated externally.

To be able to operate the supercooling circuit 30 effectively in all positions of the control slide 58, it is necessary that, in the case of all the positions of the control slide 58, the refrigerant which is coming from the supercooling circuit 30 and is to be sucked in by the screw compressor is fed to a compression space 72 which is bounded by the screw rotors 50 and the screw rotor bores 48 and also the valve wall 64 and in which the refrigerant is at a pressure level which is higher than the pressure level in the refrigerant inlet 52 and lower than the pressure level in the refrigerant outlet 54.

For this reason, an inlet 80 for the refrigerant to be sucked in from the supercooling circuit 30 via a system of lines 78 is provided in the control slide 58 in the form of a bore passing through the valve wall 64, an inlet opening 82 opening out into the compression space 72 always lying in such a way that over it there is always a compression space 72 which is closed off with respect to the refrigerant inlet 52 and the refrigerant outlet 54, or the inlet opening 82 is closed by a screw flight $\mathbf{84}_x$.

As represented in FIG. 3, in the position of the screw rotor 50 depicted in FIG. 3, the screw flight $\mathbf{84}_x$ just closes the inlet opening 82, while a future space 72', initially still open with respect to the refrigerant inlet 52, is already forming, and, as the screw rotor 50 continues to rotate, is closed with respect to the refrigerant inlet 50 by the next-following screw flight $\mathbf{84}_{x-1}$ and then comes to lie over the inlet opening 82, so that a connection then exists between the inlet 80 and this then closed compression space and refrigerant can flow into this compression space via the inlet 80.

The inlet opening 82 preferably lies in such a way that it opens out into the compression space 72 closed off by the screw flights 84 with respect to the refrigerant inlet 82.

In the case of the exemplary embodiment represented, the inlet 80 is in connection with a central receiving channel 19, which extends in the direction 60 in the control slide 58 and has on one side an opening 92 via which a connecting pipe 94 held on the compressor casing 10 protrudes into said opening, a seal 96 being provided between the central receiving channel 90 and the connecting pipe 94 and the connecting pipe 94 being of such a length that, in every position of the control slide 58, it is sealed by the seal 96 and protrudes into the central receiving channel 90, without hindering the displaceability of the control slide 58 between the positions intended for control.

The connecting pipe 94 is connected to a casing channel 98 which runs in the compressor casing 10 and is led to the connection 40 on the compressor casing 10.

An inlet channel 100, forming part of the system of lines 78, between the connection 40 and the inlet 80 in the compressor casing 10 is consequently formed by the casing channel 98, a channel 102 running in the connecting pipe 94 and the central receiving channel 90 in the control slide 58, from which the inlet 80 branches off, with the connecting pipe 94 and the receiving channel 90 forming a portion 104 of the inlet channel 100 of variable length.

Since—as already described—the screw flights 84 of the screw rotors 52 keep running over the inlet opening 82, and consequently a newly formed compression space 72 keeps being connected to the inlet 80, pressure oscillations or pulsations are produced in the inlet channel 100 with a fundamental frequency which results from the rotational speed of the screw rotors 50 driven by motor 110 multiplied by the number of screw flights 84 of the screw rotors 50.

In order to dampen such pressure oscillations or pulsations, a damper channel 120, which extends in a damper tube 122 which has been inserted into the inlet channel portion 116, is provided in the inlet channel 100, preferably in an inlet channel portion 116 of the inlet channel 100, in particular of the casing channel 98, connected directly to the outer connection 40, formed by the connection flange 112 and a pipe connection 114.

The damper channel 120 in the damper tube 122 extends in this case from a first mouth opening 124 to a second mouth opening 126 with a preferably uniform cross-section, the mouth openings 124 and 126 having cross-sectional surface areas which are smaller than the cross-sectional surface areas of the inlet channel portion 116 surrounding the damper tube 122, so that, starting from the damper channel 120, there is a sudden change in cross-section to a larger cross-sectional surface area by a factor of at least 1.5 at the two mouth openings 124 and 126.

The damper tube 122 preferably has a smaller cross-section than the inlet channel portion 116 and is held in the inlet channel portion 116 by a holder 130.

The holder 130 is formed for example as a holding ring which is provided with an external thread 127, which engages in an internal thread 128 of the inlet channel portion 116, so that a positive connection can be established between the holder 130,and the compressor casing 10.

The holder 130 and the damper tube 122 in this case divide the inlet channel portion 116 into two volumes lying outside the damper tube 122, that is a first volume 132 and a second volume 134.

The first volume 132 lies between the connection 40 and the first mouth opening 124, the first volume also being able to extend around the damper tube 122 as far as the holder 130. The second volume 134 lies between the second mouth opening 126 and the inlet 80, the second volume 134 also being able to extend around the damper tube 122 as far as the holder 130.

In the case of the solution according to the invention, the length of the damper channel 120 in the damper tube 122 is then dimensioned in such a way that it corresponds in the order of magnitude to a quarter or an integral multiple of a quarter of the wavelength of a pressure oscillation or pulsation forming with the fundamental frequency in the refrigerant, so that the pressure oscillations or pulsations are damped in particular by the combination of the damper channel 120 with the first volume 132 and the second volume 134.

With such a solution, a reduction in the pressure differences between peak values of the pulsations of 5 bar to pressure differences between peak values of the oscillations of 1 bar is possible for example.

With the solution according to the invention there is the possibility of appreciably reducing the pressure oscillations or pulsations already in the compressor casing 10 and consequently avoiding that these oscillations or pulsations propagate into the pipeline system of the supercooling circuit 30 leading away from the compressor casing 10 and lead to undesired oscillations in said system.

The damper channel 120 is in this case effective independently of whether or not the supercooling circuit 30 is effective.

In particular in the case of a supercooling circuit 30 that is not effective, there is likewise an increased tendency for pressure oscillations or pulsations to spread into the pipeline system of the supercooling circuit 30 running outside the compressor casing 10 on account of the refrigerant present in the system of lines 78, so that the damper channel 120 also contributes to a considerable degree to the damping of pressure oscillations or pulsations when the supercooling circuit 30 is not effective.

Figure 4:
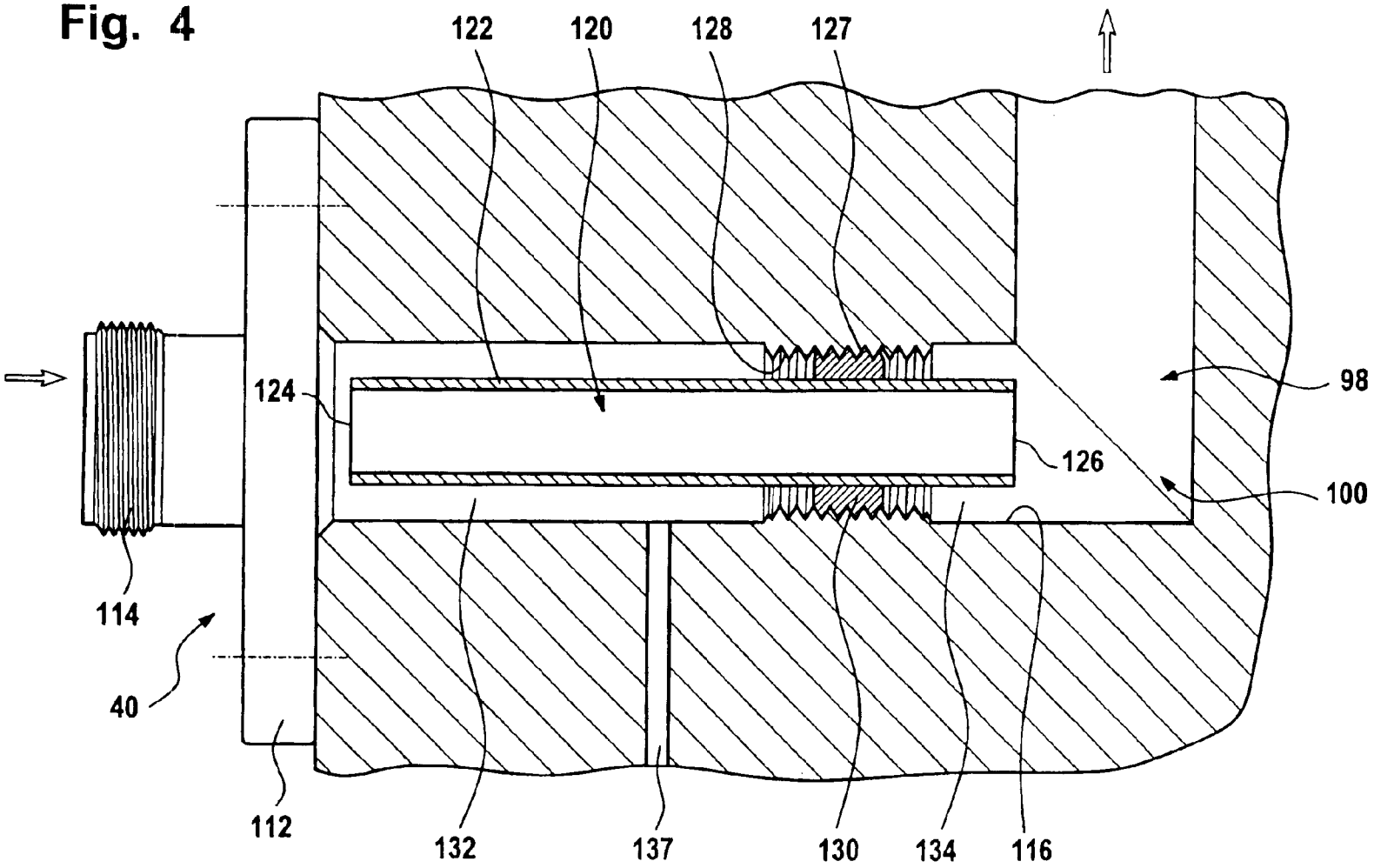
FIG. 4 shows an enlarged representation in the form of a detail of a section through the compressor casing of the first exemplary embodiment in the region of an inlet channel following an outer connection.

In order to prevent oil from accumulating in the inlet channel 100 when the supercooling circuit 30 is not effective, and thereby impairing the effectiveness of the damper channel 120 by the latter being flooded at least partially with oil, associated with the inlet channel 100—as represented in FIG. 1—is an oil drain 136, which on the one hand opens out via an oil drain channel 137, represented in FIG. 4, into the inlet channel 100 in the region of the inlet channel portion 116, preferably into the first volume 132 of the same, and on the other hand is connected to the suction connection 12, preferably to the end on the suction side of the cooling circuit 24.

Furthermore, the oil drain 136 also comprises a valve 138, which can be actuated at intervals, for example when the supercooling circuit 30 is not active, in order in these intervals to discharge oil collecting in the inlet channel 100, in particular in the first volume 132 of the same.

The oil drain 136 does not necessarily have to operate even when the supercooling circuit 30 is effective, since, with the supercooling circuit 30 effective, the refrigerant flowing through the inlet channel 100 generally causes oil collecting there to be fed to the compression spaces 72.

It is also possible, however, to operate the oil drain 136 while the supercooling circuit 30 is effective, in order to be certain of avoiding any kind of oil accumulation in the inlet channel 100, in particular in the inlet channel portion 116 receiving the damper channel 120.

Figure 5:
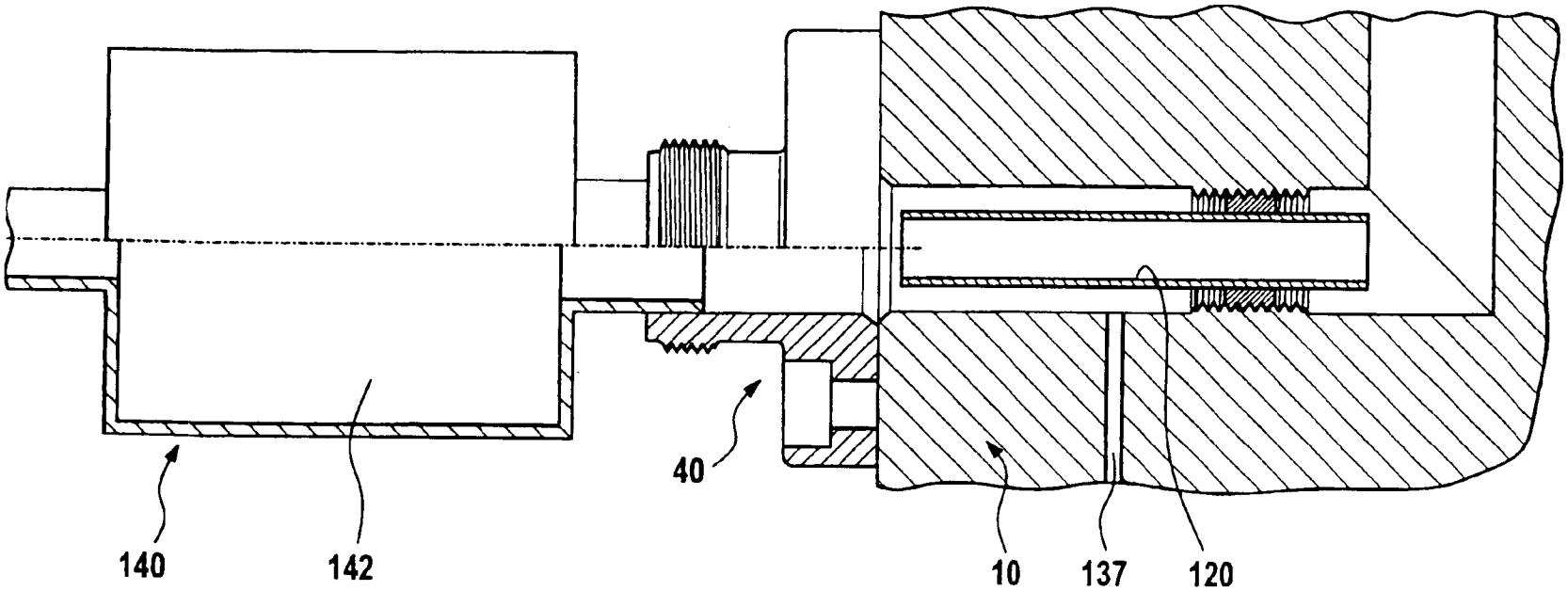
FIG. 5 shows a section similar to FIG. 4 in the case of a second exemplary embodiment of a screw compressor according to the invention.

In the case of a second exemplary embodiment, represented in FIG. 5, also provided in addition to the pressure channel 120, to be precise in a portion 140 of a pipeline system of the supercooling circuit 30 connected directly to the connection 40, is an expansion volume 142, which creates the possibility of further damping pressure oscillations or pulsations still spreading from the compressor casing 10 into the portion 140 of the pipeline system, and consequently further reducing their effects on the pipeline system.

Otherwise, the second exemplary embodiment is formed in the same way as the first exemplary embodiment, so that reference is made to the full content of the statements made with respect to the latter.

What is claimed is:

1. Screw compressor for operation in a cooling circuit provided with a subcooling circuit, said compressor comprising:

two screw rotors which are disposed in screw rotor bores in a compressor casing for compressing a refrigerant of said cooling circuit which enters at a refrigerant inlet and it is discharged into said cooling circuit at a refrigerant outlet, said subcooling circuit cooling the refrigerant in the cooling circuit before the refrigerant enters an evaporator, a second inlet provided in the compressor casing for expanded refrigerant from an outlet of said subcooling circuit, said expanded refrigerant passing to the second inlet in a system of lines, the second inlet being disposed in such a way that it opens out into compression spaces enclosed by the screw rotors and the screw rotor bores, and a damper channel preceding the second inlet for suppressing oscillations or pulsations occurring in said system of lines, said damper channel being associated with the system of lines and containing expanded refrigerant from the subcooling circuit.

2. Screw compressor according to claim 1, wherein the damper channel is disposed in the compressor casing.

3. Screw compressor according to claim 2, wherein the damper channel is formed in a casing portion which receives the screw rotor bores.

4. Screw compressor according to claim 1, wherein an inlet channel running through the compressor casing is provided as part of the system of lines which leads from an outer connection on the compressor casing, connected to the subcooling circuit, to the second inlet, and in that the damper channel is disposed in the inlet channel.

5. Screw compressor according to claim 1, wherein the damper channel is disposed in a part which can be inserted into the compressor casing.

6. Screw compressor according to claim 5, wherein the part which can be inserted into the compressor casing can be inserted into the inlet channel in the compressor casing.

7. Screw compressor according to claim 5, wherein the insertable part comprises a damper tube and a holder, by which the damper tube can be fixed in the compressor casing.

8. Screw compressor according to claim 1, wherein the compressor casing comprises a control slide, and in that the second inlet is disposed in the control slide and can be displaced with it.

9. Screw compressor according to claim 8, wherein the second inlet in the control slide is connected to the outer connection via a portion of the inlet channel of variable length.

10. Screw compressor according to claim 9, wherein the portion of the inlet channel of variable length is telescopically formed.

11. Screw compressor according to claim 9, wherein the portion of the inlet channel of variable length is formed by a connecting pipe which can be pushed into a receiving channel.

12. Screw compressor according to claim 1, wherein the damper channel is of a length which corresponds approximately to a quarter of the wavelength of the pressure oscillations to be damped or an odd multiple of the same.

13. Screw compressor according to claim 1, wherein the damper channel opens out with a first mouth opening into a first volume lying between the outer connection and the first mouth opening.

14. Screw compressor according to claim 1, wherein the damper channel opens out with a second mouth opening into a second volume lying between said second opening and the inlet.

15. Screw compressor according to claim 13, wherein there is a sudden change in the cross-sectional surface area at the transition from one of the mouth openings into the respective volume.

16. Screw compressor according to claim 15, wherein the sudden change in the crosssectional surface area is at least a factor of 1.5.

17. Screw compressor according to claim 13, wherein the first volume, lying between the first mouth opening and the outer connection, lies in the compressor casing.

18. Screw compressor according to claim 17, wherein the first volume lies in an inlet channel portion.

19. Screw compressor according to claim 14, wherein the second volume, lying between the second mouth opening and the second inlet, lies in the compressor casing.

20. Screw compressor according to claim 19, wherein the second volume lies in the inlet channel portion.

21. Screw compressor according to claim 1, wherein the outer connection has an associated expansion volume.

22. Screw compressor according to claim 1, wherein the system of lines is connected to an oil drain.

23. Screw compressor according to claim 22, wherein the oil drain opens out into the inlet channel.

24. Screw compressor according to claim 23, wherein the oil drain opens out into the inlet channel portion receive the damper channel.

25. Screw compressor according to claim 24, wherein the oil drain opens out into the first volume.

* * * * *

UNITED STATES PATENT AND TRADEMARK OFFICE

CERTIFICATE OF CORRECTION

PATENT NO. : 6,898,948 B2
DATED : May 31, 2005
INVENTOR(S) : Roelke et al.

It is certified that error appears in the above-identified patent and that said Letters Patent is hereby corrected as shown below:

Column 8,
Line 24, delete the word "it" after the word "and".

Signed and Sealed this

Thirtieth Day of August, 2005

JON W. DUDAS
*Director of the United States Patent and Trademark Office*